United States Patent [19]

Wright et al.

[11] 4,189,378

[45] Feb. 19, 1980

[54] SPIRAL SEPARATORS

[75] Inventors: Douglas C. Wright, Terranora; Sidney N. Roberts, Banora Point, both of Australia

[73] Assignees: Minore Pty. Ltd., Murwillumbah; Rosidium Pty. Ltd., Banora Point, both of Australia

[21] Appl. No.: 922,804

[22] Filed: Jul. 7, 1978

[30] Foreign Application Priority Data

Jan. 16, 1978 [AU] Australia ..... PD3039

[51] Int. Cl.[2] ..... B03B 5/52

[52] U.S. Cl. ..... 209/459; 209/493; 209/494

[58] Field of Search ..... 209/211, 459, 493, 494, 209/490, 434, 441, 439, 454, 458, 460, 472, 477, 697, 696

[56] References Cited

U.S. PATENT DOCUMENTS

| | | | |
|---|---|---|---|
| 2,615,572 | 10/1952 | Hodge | 209/211 |
| 2,700,469 | 1/1955 | Humphreys | 209/211 |
| 2,724,498 | 11/1955 | Beresford | 209/697 |
| 3,319,788 | 5/1967 | Reichert | 209/493 |
| 3,371,784 | 3/1968 | Conway | 209/493 X |

*Primary Examiner*—Ralph J. Hill

*Attorney, Agent, or Firm*—Haseltine, Lake & Waters

[57] ABSTRACT

The helical sluice, or spiral, of a mineral separator used for mineral separation, has a series of take-off openings to carry off strata of dense minerals which form when a pulp of water and minerals to be separated pass through the spiral. Each take-off opening is a slot in the spiral bottom, transverse to the flow, and its effective length, or throat gap, may be varied by a tongue slidably engaged in the slot and having a splitter blade extending up from its leading end to deflect dense strata into the throat gap. A second slot is formed in the tongue to take off middlings, and this is also adjustable, by a slide.

3 Claims, 4 Drawing Figures

SPIRAL SEPARATORS

BACKGROUND OF THE INVENTION

This invention relates to improvements in spiral separators used for mineral separation.

A conventional spiral separator for mineral separation has a pair of spirals, or helical sluices, mounted coaxially about a vertical central column, a pulp of water and the minerals to be separated being fed into the upper ends of the spirals to flow down them and form bands or strata containing minerals of different density characteristics, splitter blades mounted at intervals in each spiral dividing the strata, and take-off openings, normally circular, carrying off the material to one side of the splitter blade.

The characteristics of different types of pulp may, however, vary considerably, and the location of take-offs which may be satisfactory for one mineral separation operation may be quite unsatisfactory for another.

It is uneconomical to provide a range of spiral concentrators with take-offs located differently, or to reposition the take-offs of an existing mineral separation apparatus, and it is well known to attempt to compensate for flow variations of different kinds of pulp by angular adjustment of the splitter blades. This, however, is not fully satisfactory as a splitter blade, to achieve good results, should be directed into the flow of the pulp, and not across it. When a splitter blade is turned either inwards or outwards, with respect to the spiral, with the object of taking off the desired proportion of pulp into concentrate, the continuity of the flow of the pulp is adversely affected and sand barring of the pulp takes place in the spiral.

SUMMARY OF THE INVENTION

The present invention has been devised with the principal object of providing, for a spiral separator, a take-off assembly which may be adjusted to give very good results for pulps having a wide range of characteristic differences.

With this and other objects in view, the invention resides broadly in a spiral separator for mineral separation, of the type having a helical sluice or spiral, means for feeding a pulp of water and minerals to be separated to the upper part of the spiral, and take-off openings in the spiral to withdraw mineral-bearing strata of the pulp; wherein a take-off opening of the spiral is a slot in the bottom part of the spiral, transverse to the direction of flow, and there is provided a throat gap adjustment member adapted to be advanced or retracted in the slot to vary the throat gap between one end of the slot and the throat gap adjustment member. Preferably the throat gap adjustment member is a tongue slidably engaged in the slot, and preferably its leading end is provided with an up-standing splitter blade for dividing strata of the pulp. The tongue itself may be formed with a second slot, extending from the splitter blade and transverse to the direction of flow, and adjustable by a slide, this variable second slot taking off middlings from the pulp, while concentrate is taken off through the throat gap. Other features of the invention will become apparent from the following description.

DESCRIPTION OF THE PREFERRED EMBODIMENT

Figure 1:
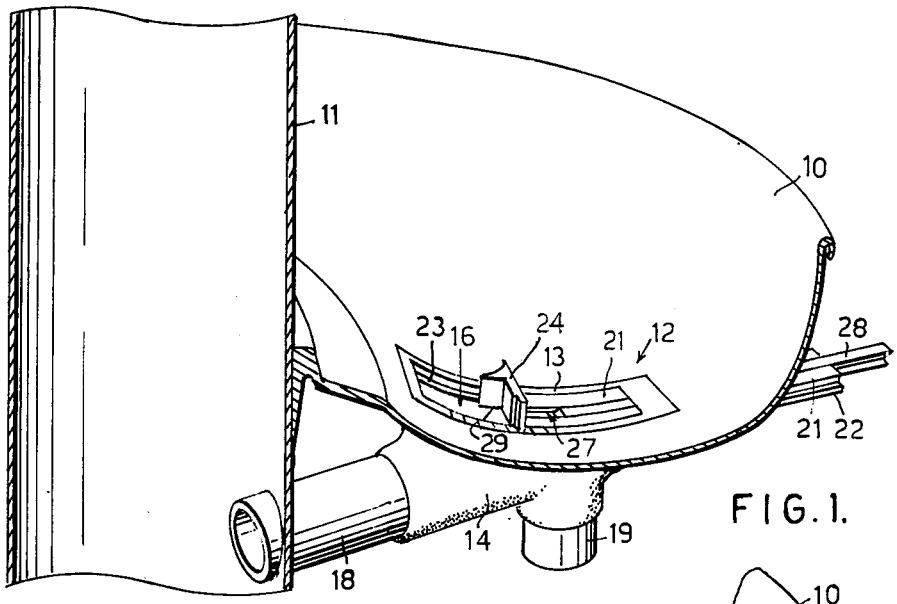
FIG. 1 is a perspective view of part of a spiral separator according to the invention.

A helical sluice or spiral 10 of a separator used in mineral separation is fitted closely about and secured to a vertical tubular central column 11. At intervals along the spiral similar take-off assemblies, one of which is shown in the drawings, are fitted to the spiral.

The take-off assembly includes a body 12 which is rectangular in plan view, and which is closely fitted and secured in a correspondingly shaped aperture formed transversely in the bottom part of the spiral. The top face 13 of the body is curved to conform to the curvature of the part of the spiral in which it is fitted, so that the top surface will be substantially flush with the spiral bottom. The body 12 is held firmly in place by fibreglass, indicated at 14, moulded about it and to the spiral, which is made of similar material.

An elongated rectangular opening 16 through the top of the body 12 leads into a chamber 17 within the body, one end of this chamber inclining downwards to lead into a concentrator outlet pipe 18 extending from the inside end of the body 12 and leading obliquely down into the interior of the central column 11. From the other end portion of the chamber 17 a middlings outlet pipe 19 leads downwardly. A transverse well 20 extending upwardly from the bottom of the chamber 17 is located between the passages through the concentrate outlet pipe 18 and the middlings outlet pipe 19.

A flexible parallel-sided tongue 21, which is moulded of a suitable plastics material, passes closely but slidably through the outside end of the body 12, and is formed at its sides with guide flanges 22 slidably engaged in grooves 23 at both sides of the opening 16 and curved to conform to the curvature of the top face 13 of the body. The tongue 21 may be advanced or retracted manually so that the throat gap, or opening between the leading end of the tongue and the inside end of the opening 16, may be adjustably varied.

A splitter 24 is secured to and extends upwardly from the extremity of the tongue 21. The outer face of the splitter is flat and aligned in the direction of flow of material in the spiral 10. The up-stream edge of the splitter is fairly sharp and from this edge the inside face of the splitter curves arcuately back and towards the inside part of the spiral to form a deflector 25.

Also secured to the inside extremity of the tongue 21 is a downwardly extending divider 26 extending transversely across the chamber 17 and of inverted V-shape in cross section, having one blade inclining down towards the passage through the concentrate outlet pipe 18, and a second blade inclining down towards the passage through the middlings outlet pipe 19.

Figure 2:
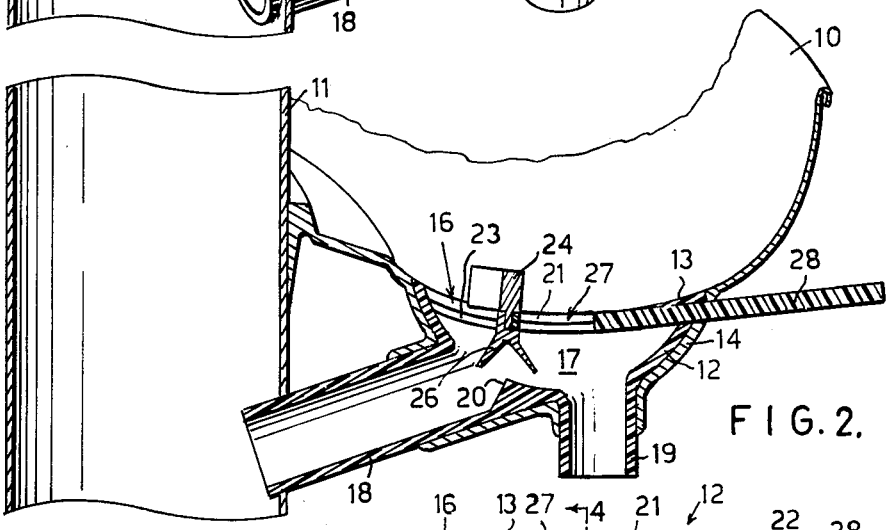
FIG. 2 is a sectional view of the apparatus shown in FIG. 1.
Figure 3:
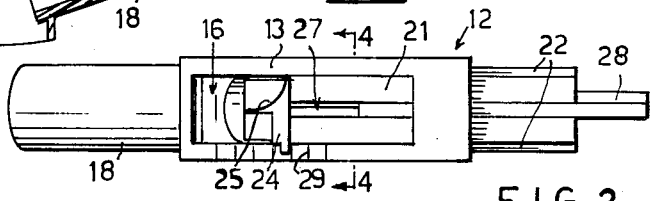
FIG. 3 is a plan view of the take-off unit removed from the spiral separator.
Figure 4:
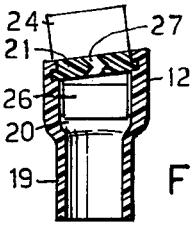
FIG. 4 is a sectional view along line 4—4 in FIG. 3.

The flexible tongue 21 is divided centrally from its outer end to a position near the splitter 24 by a slot 27 in which there is engaged an adjustable slide 28. The slot 27, as shown in FIG. 4, has its upper part inclining downwardly at an angle of about 45° from the top surface of the tongue and in an up-stream direction with respect to the spiral 10, the lower part of the slot inclining downwardly and in a down-stream direction. The slide 28 engaged in the slot is of corresponding cross-section. When the slide 28 is drawn outwardly in relation to the tongue 21, part of the slot 27 adjacent to the splitter 24 is opened, as shown in FIGS. 1, 2 and 3.

In use, when a pulp of water and minerals to be separated flows through the spiral 10, the minerals form bands or strata, the densest minerals separating into a band along the inside part of the spiral. By manual adjustment of the flexible tongue 21, the position of the splitter 24, and the throat gap or opening 16 into the chamber 17 may be adjustably varied so that there is an optimum take-off of the concentrate. The splitter and the throat gap are easily adjustable without the angular relationship of the splitter to the direction of flow being altered and therefore the concentrate is taken off without any adverse effect on the continuity of flow. The concentrate passing into the chamber 17 is directed by the divider 26 into the concentrate outlet pipe 19 and flows therefrom into the central column 11, being withdrawn from the lower end of this column.

If it is desired to extract middlings as well as concentrate from the material flowing through the spiral, the slide 21 is retracted, as shown in the drawings, to open part of the slot 27 to appropriate extent to achieve optimum take-off of the minerals required to be separated. These mineral particles are likely to travel close to the surface of the spiral, so they will pass through the opened part of the slot 27 and be directed by the divider 26 to the middlings outlet pipe 19, and thence by way of any suitable conduit (not shown).

When a setting of the tongue 21 has been determined to give optimum results for a particular mineral being separated, it may be repeated in other separators treating similar material, and to facilitate this a calibrated scale is marked on the upper face 13 as indicated at 29. If desired a calibrated scale may also be marked on the tongue 21 to facilitate the setting of the slide 28 to an adjustment found experimentally to give optimum results in the take-off of middlings.

Although the splitter 24 will be generally necessary when middlings as well as concentrate are to be taken off from the flow through the spiral, when concentrates only are to be extracted the splitter may be omitted.

We claim:

1. An improved spiral separator for mineral separation, of the type having a helical sluice or spiral, means for feeding a pulp of water and minerals to be separated to the upper part of the spiral, and take-off openings in the spiral to withdraw mineral bearing strata of the pulp, wherein said improvement comprises: a take-off opening of the spiral in the form of a slot in the bottom part of the spiral, said slot being transverse to the direction of flow; an infinitely variable throat gap adjustment member adapted to be advanced or retracted for varying the throat gap between it and one end of said slot, while closing off the remainder of the slot during flow of product; said throat gap adjustment member is a tongue slidably engaged in, and closing an outer part of, said slot; a splitter blade extends upwardly from the end of said tongue defining one end of said throat gap and is adapted to separate and deflect into said throat gap a part of the flow of pulp; and a second slot is formed in said tongue, transverse to the direction of flow through said spiral.

2. A spiral separator according to claim 1 wherein:

secondary adjustment means are provided for adjustably varying the length of said second slot extending from said splitter blade.

3. A spiral separator according to claim 2 wherein:

a chamber is provided below said take-off opening and has a concentrate outlet and a middlings outlet, and means are provided for directing material passing through said throat gap to said concentrate outlet, and for directing material passing through said second slot to said middlings outlet.

* * * * *